US006716113B1

(12) United States Patent
Manning et al.

(10) Patent No.: US 6,716,113 B1
(45) Date of Patent: Apr. 6, 2004

(54) GOLF PUTTING TRAINING DEVICE

(76) Inventors: Michael J. Manning, 1843 W. Water St., Elmira, NY (US) 14905; Paul C. Steinhilper, 377 Fulton St., Elmira, NY (US) 14904

( * ) Notice: Subject to any disclaimer, the term of this patent is extended or adjusted under 35 U.S.C. 154(b) by 0 days.

(21) Appl. No.: 10/142,433

(22) Filed: May 10, 2002

(51) Int. Cl.[7] ..... A63B 53/06; A63B 53/16; A63B 57/00; A63B 69/36; A63B 67/02

(52) U.S. Cl. ..... 473/261; 473/278; 473/166

(58) Field of Search ..... 473/159, 162, 473/163, 166, 194, 182, 132, 137, 177, 191, 278, 261, 264, 263, 262, 257; 273/396, 397; D21/792

(56) References Cited

U.S. PATENT DOCUMENTS

| | | | | | |
|---|---|---|---|---|---|
| 1,012,820 | A | * | 12/1911 | Cory | 473/158 |
| 1,667,481 | A | * | 4/1928 | Lange et al. | 473/136 |
| 2,110,925 | A | * | 3/1938 | Trangmar | 473/163 |
| 2,450,125 | A | * | 9/1948 | Dunfee | 473/163 |
| 2,460,080 | A | * | 1/1949 | Gerding | 473/159 |
| 2,609,199 | A | * | 9/1952 | Koener | 473/132 |
| 3,856,313 | A | * | 12/1974 | Tierney | 473/162 |
| 4,620,708 | A | | 11/1986 | Meyer et al. | |
| 5,102,141 | A | * | 4/1992 | Jordan | 473/163 |
| 5,242,169 | A | * | 9/1993 | Laabs et al. | 473/184 |
| 5,261,670 | A | * | 11/1993 | Mull | 473/182 |
| 5,437,458 | A | | 8/1995 | Springer | |
| 5,501,452 | A | | 3/1996 | Halvorson | |
| 5,501,462 | A | * | 3/1996 | Shih | 473/163 |
| 5,595,543 | A | | 1/1997 | Wolk | |
| 5,672,114 | A | * | 9/1997 | Tu | 473/164 |
| 5,718,638 | A | | 2/1998 | Kameda | |
| D431,855 | S | | 10/2000 | Rose | |

* cited by examiner

*Primary Examiner*—Gregory Vidovich
*Assistant Examiner*—Alvin A. Hunter, Jr.

(57) ABSTRACT

A golf putting training device for improving the putting of a golfer. The golf putting training device includes a body member having a base portion. The base portion is designed for resting on a support surface. The body member has a distal wall. The distal wall is coupled to a distal edge of the base portion. The distal wall is designed for hampering the back swing of the golfer when the golfer does not draw the putter back straight. The body member has a cut out portion. The cut out portion extends in from a leading edge of the base portion. The cut out portion is designed for receiving a golf ball whereby the cut out portion aligns the golf ball with a longitudinal axis of the base portion.

14 Claims, 4 Drawing Sheets

GOLF PUTTING TRAINING DEVICE

BACKGROUND OF THE INVENTION

1. Field of the Invention

The present invention relates to golfing aides and more particularly pertains to a new golf putting training device for improving the putting of a golfer.

2. Description of the Prior Art

The use of golfing aides is known in the prior art. U.S. Pat. No. 5,718,638 describes a device for automatically teeing up a golf ball for a golfer. Another type of golfing aide is U.S. Pat. No. 5,595,543 having a system for practicing putting of a golf ball by a golfer. U.S. Pat. No. 5,437,458 has a training device for training a golfer to have an even swing while putting. U.S. Pat. No. 5,501,452 has a device for training the golfer to putt consistently through muscle memory. U.S. Pat. No. 5,595,543 has an apparatus for training a golfer to putt correctly. U.S. Pat. No. Des. 431,855 shows a portable putting practice aide.

While these devices fulfill their respective, particular objectives and requirements, the need remains for a device that has certain improved features permits the golfer to repeat the stroke of the putt without having to take time to gather a golf ball and place it.

SUMMARY OF THE INVENTION

The present invention meets the needs presented above by a ball assembly that can store several golf balls and allows the user to quickly have another ball ready to putt to provide a more thorough training of the muscles of the golfer.

Still yet another object of the present invention is to provide a new golf putting training device that allows a user to gauge the distance the head of the putter needs to be drawn back for a desired length of a putt.

Even still another object of the present invention is to provide a new golf putting training device that allows a user to further practice putting y permitting the golfer to putt golf balls back towards the body member.

To this end, the present invention generally comprises a body member having a base portion. The base portion is designed for resting on a support surface. The body member has a distal wall. The distal wall is coupled to a distal edge of the base portion. The distal wall is designed for hampering the back swing of the golfer when the golfer does not draw the putter back straight. The body member has a cut out portion. The cut out portion extends in from a leading edge of the base portion. The cut out portion is designed for receiving a golf ball whereby the cut out portion aligns the golf ball with a longitudinal axis of the base portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
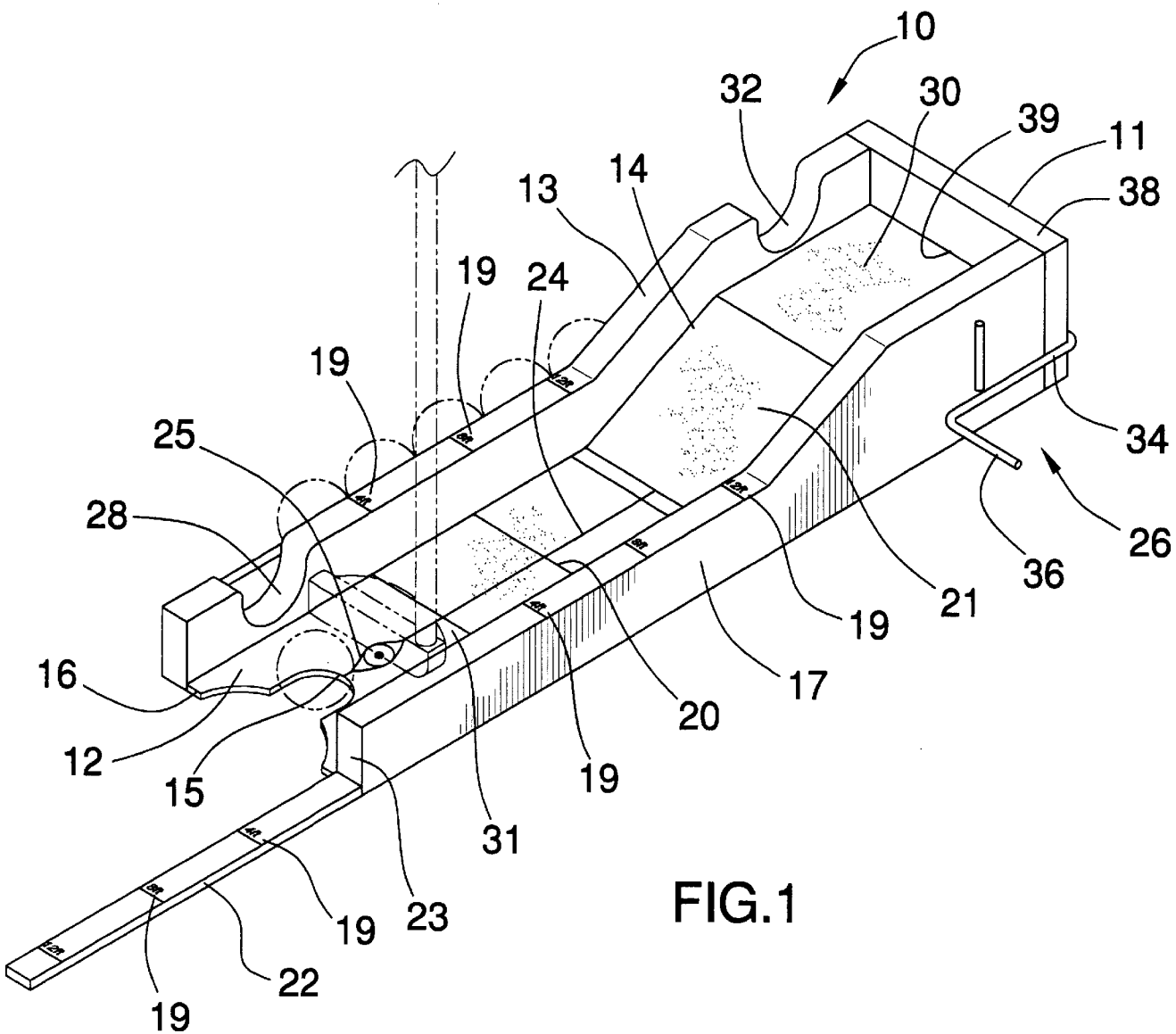
FIG. 1 is a front perspective view of a new golf putting training device according to the present invention.
Figure 2:
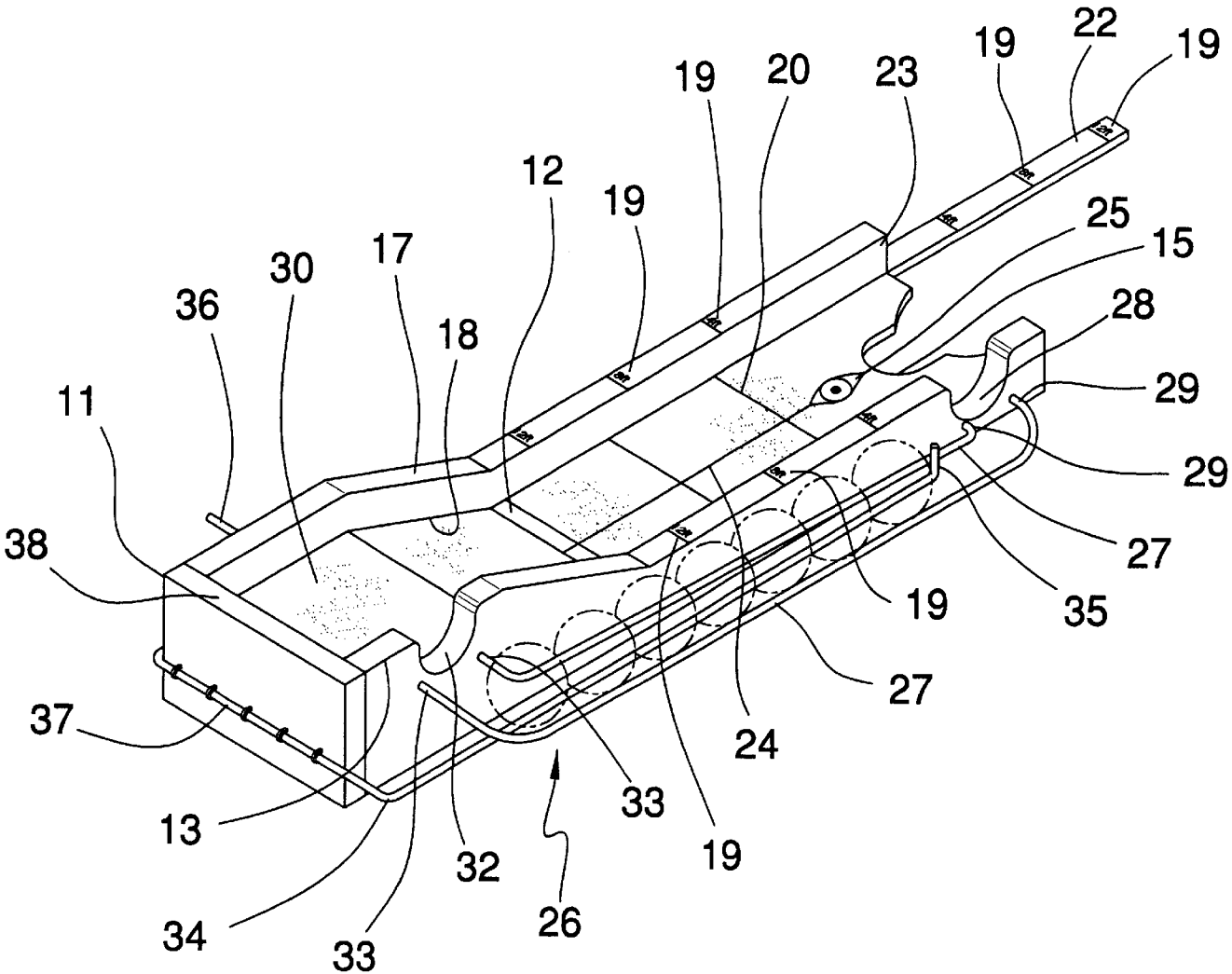
FIG. 2 is a rear perspective view of the present invention.
Figure 3:
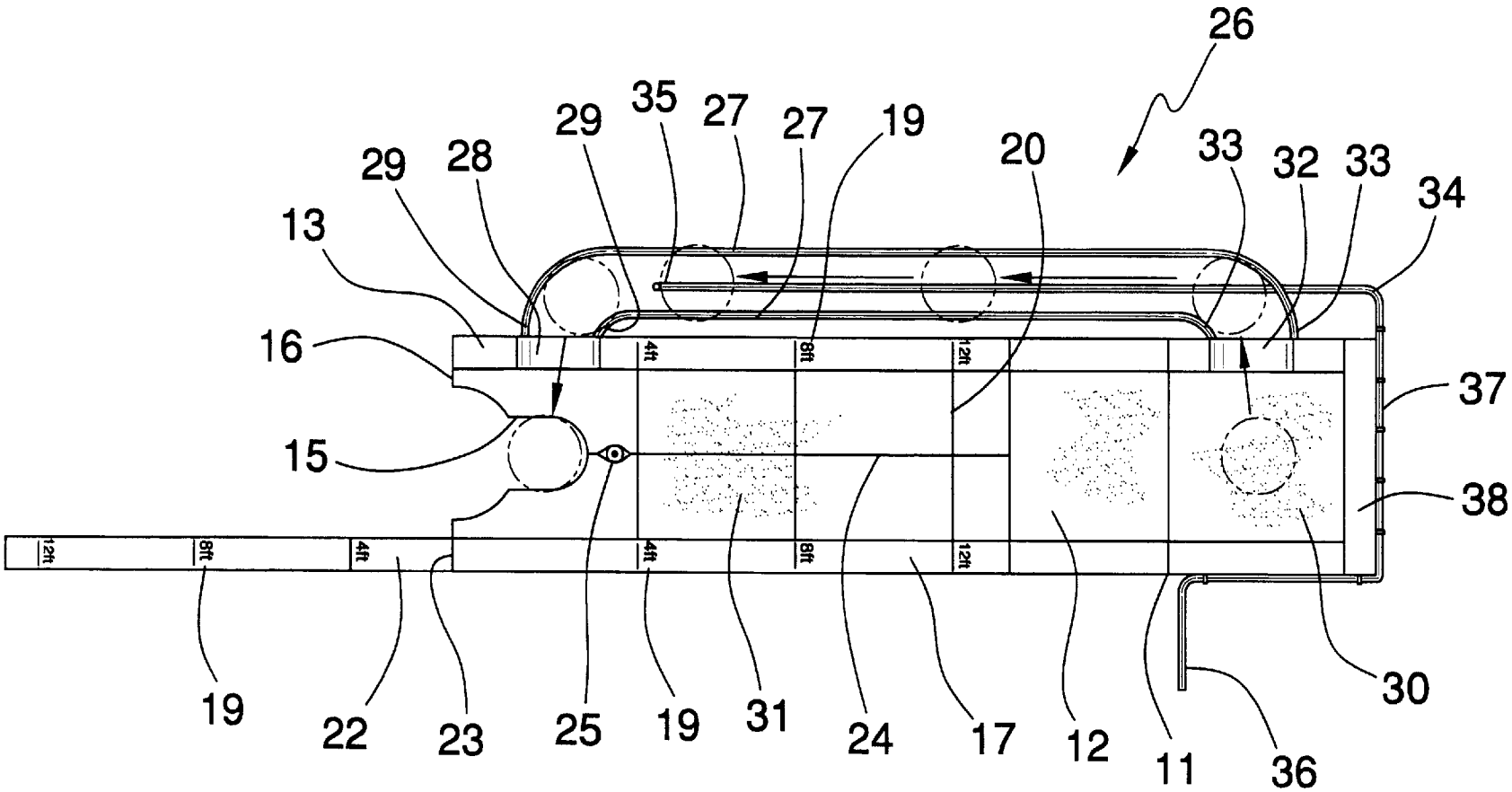
FIG. 3 is a top view of the present invention.
Figure 4:
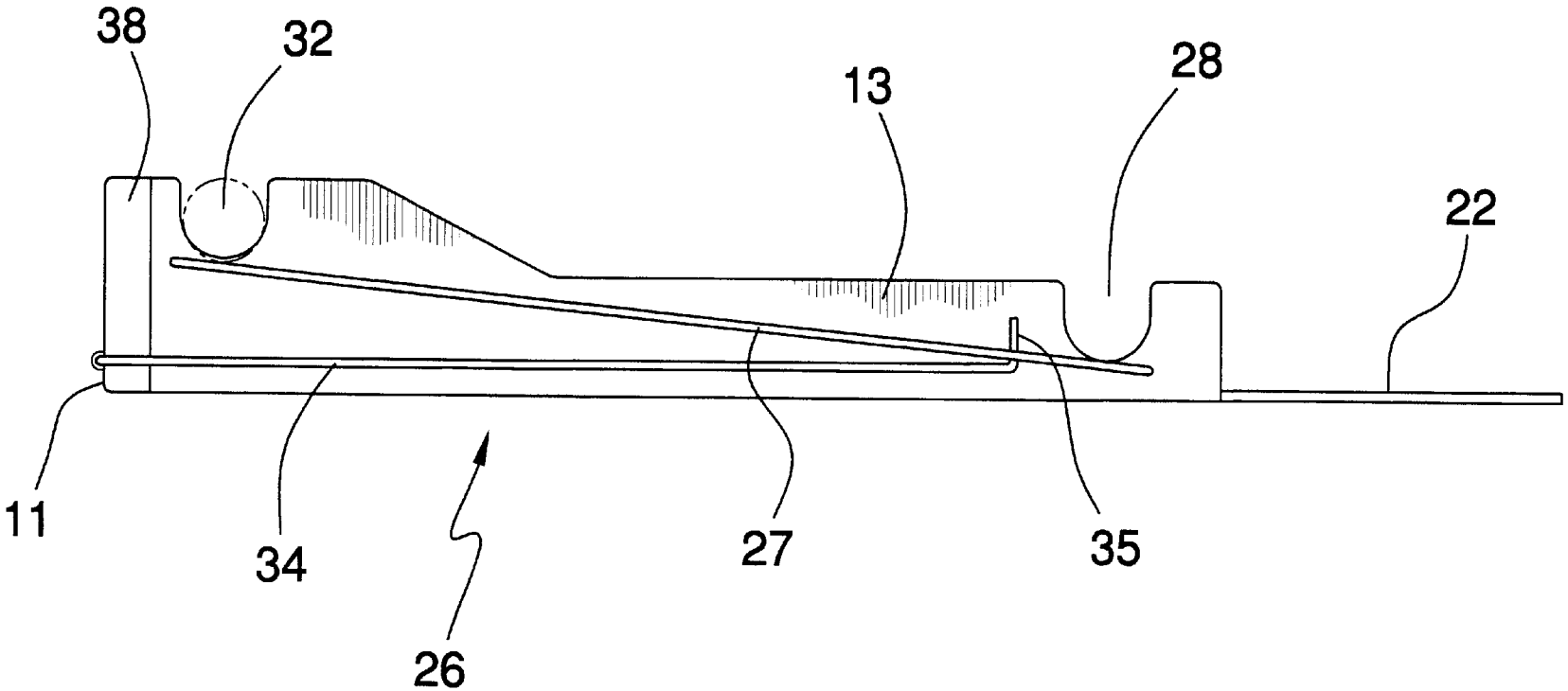
FIG. 4 is a side view of the present invention.

With reference now to the drawings, and in particular to FIGS. 1 through 4 thereof, a new golf putting training device embodying the principles and concepts of the present invention and generally designated by the reference numeral 10 will be described.

As best illustrated in FIGS. 1 through 4, the golf putting training device 10 generally comprises a body member 11 having a base portion 12. The base portion 12 is designed for resting on a support surface. The body member 11 has a distal wall 13. The distal wall 13 is coupled to a distal edge 14 of the base portion 12. The distal wall 13 is designed for hampering the back swing of the golfer when the golfer does not draw the putter back straight. The body member 11 has a cut out portion 15. The cut out portion 15 extends in from a leading edge 16 of the base portion 12. The cut out portion 15 is designed for receiving a golf ball whereby the cut out portion 15 aligns the golf ball with a longitudinal axis of the base portion 12.

The body member 11 has a proximal wall 17. The proximal wall 17 is coupled to a proximal edge 18 of the base portion 12 opposite the distal wall 13. The proximal wall 17 and the distal wall 13 are designed for hampering the back swing of the golfer when the golfer rotates the head of the putter.

The proximal wall 17 and the distal wall 13 have a plurality distance indicia 19. Each of the distance indicia 19 is designed for indicating an approximate distance the golf ball will roll when the putter is drawn back and aligned with the associated pair of the distance indicia 19.

The base portion 12 of the body member 11 has a plurality of medial indicia 20. Each of the medial indicia 20 is aligned between one of the distance indicia 19 on the distal wall 13 and one of the distance indicia 19 of the proximal wall 17. The medial indicia 20 extends across an upper surface 21 of the base portion 12 whereby each of the medial indicia 20 is designed for facilitating alignment of the head of the putter with the distance indicia 19.

The body member 11 has a gauge member 22. The gauge member 22 outwardly extends from a front end 23 of the proximal wall 17. The gage member has the plurality of the distance indicia 19 whereby the distance indicia 19 of the gauge member 22 are designed for indicating a distance the golf ball will travel when the head of the putter is aligned with one of the distance indicia 19 on the follow through of the golfers stroke.

The base portion 12 of the body member 11 has a center line indicia 24. The center line extends along the upper surface 21 of the base portion 12 whereby the center line indicia 24 is aligned with the longitudinal axis of the base portion 12. The center line indicia 24 is designed for facilitating alignment of a center of the head of the putter with the longitudinal axis of the base portion 12 when the head of the putter is being drawn back.

The base portion 12 of the body member 11 has an eye indicia 25. The eye indicia 25 is positioned on the upper surface 21 of the base portion 12 proximate the cut out portion 15 of the base portion 12. The eye indicia 25 is designed for reminding the golfer to continue looking at the golf ball throughout the swing.

A ball assembly 26 is coupled to the body member 11. The ball assembly 26 is designed for storing golf balls. The ball assembly 26 is designed for depositing one of the golf balls proximate the cut out portion 15 of the base portion 12 of the body member 11.

The ball assembly 26 has a pair of guide rails 27. The guide rails 27 are in a space relationship. The guide rails 27 are designed for supporting the golf balls between the guide rails 27 whereby the golf balls freely roll along a length of the guide rails 27.

The distal wall 13 of the body member 11 has an exit cutout 28. The exit cutout 28 is positioned adjacent the leading edge 16 of the base portion 12. The guide rails 27 of the ball assembly 26 are coupled to the distal wall 13 of the body member 11. An exit end 29 of each of the guide rails 27 is positioned proximate the exit cutout 28 of the distal wall 13 whereby the guide rails 27 are designed for guiding the golf ball through the exit cutout 28 for delivering the golf ball to the cut out portion 15 of the base portion 12.

The base portion 12 of the body member 11 has a rear portion 30. The rear portion 30 of the base portion 12 is elevated with respect to a main portion 31 of the base portion 12. The distal wall 13 of the body member 11 has an entrance cutout 32. The entrance cutout 32 is positioned proximate the rear portion 30 of the base portion 12. An entrance end 33 of each of the guide rails 27 is positioned proximate the entrance cutout 32 whereby the guide rails 27 are designed for receiving the golf ball pushed through the entrance cutout 32 in the distal wall 13.

The ball assembly 26 has a restricting arm 34. The restricting arm 34 is pivotally coupled to the body member 11. The restricting arm 34 is designed for inhibiting rolling of the golf balls along the guide rails 27. The restricting arm 34 is designed for being engaged by a foot of the golfer whereby the restricting arm 34 pivots when engaged by the foot of the golfer for releasing one of the gold balls to roll down the guide rails 27 and delivered through the exit cutout 28 to the cut out portion 15 of the base portion 12.

The restricting arm 34 of the ball assembly 26 has a detaining portion 35. The detaining portion 35 extends between the guide rails 27 whereby the detaining portion 35 is designed for blocking the golf balls from rolling along the guide rails 27. The detaining portion 35 of the restricting arm 34 is designed for being pivoted under the golf balls for allowing, the golf balls to roll along the guide rails 27.

The restricting arm 34 of the ball assembly 26 has an engaging portion 36. The engaging portion 36 of the restricting arm 34 is positioned along the proximal wall 17 of the body member 11. The engaging portion 36 is designed for being engaged by the foot of the golfer for selectively pivoting the detaining portion 35.

The restricting arm 34 of the ball assembly 26 has a medial portion 37. The medial portion 37 is pivotally coupled to a rear wall 38 of the body member 11. The rear wall 38 of the body member 11 is coupled to a rear end 39 of the base portion 12 of the body member 11.

In use, the golfer places the body member 11 on the floor. Golf balls are then placed one the rear portion 30 of the base portion 12 and the and fed through the entrance cutout 32. The golf then steps down on and releases the engaging portion 36 of the restricting arm 34 and releases one of the golf balls and ensures positioning of the golf ball in the cut out portion 15 of the base portion 12. The head of the putter is then positioned between the distal wall 13 and the proximal wall 17. The golfer then brings the head of the putter back in a back swing and tries to keep the head of the putter positioned between the distal wall 13 and proximal wall 17 and aligns the head of the putter with the distance indicia 19 for the length of shot he wants make. The head of the putter is then brought forward to strike the golf ball and the head of the putter is varies through with the follow through to be aligned with the distance indicia 19 on the gauge member 22 for the length of the shot the golfer is trying to make. The golfer continues to the process to improve the smoothness and accuracy of the putting of the golf ball.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A golf putting training device for improving the putting of a golfer, the golf putting training device comprising:

a body member having a base portion, said base portion being adapted for resting on a support surface, said body member having a distal wall, said distal wall being coupled to a distal edge of said base portion, said distal wall being adapted for hampering the back swing of the golfer when the golfer does not draw the putter back straight, said body member having a cut out portion, said cut out portion extending in from a leading edge of said base portion, said cut out portion being adapted for receiving a golf ball, said cut out portion being aligned with a longitudinal axis of said body member such that said cut out portion aligns the golf ball with the longitudinal axis of said base portion;

a ball assembly being coupled to said body member, said ball assembly being adapted for storing golf balls, said ball assembly being adapted for depositing one of the golf balls proximate said cut out portion of said base portion of said body member;

said ball assembly having a pair of guide rails, said guide rails being in a space relationship, said guide rails being adapted for supporting the golf balls between said guide rails such that the golf balls freely roll along a length of said guide rails;

said distal wall of said body member having an exit cutout, said exit cutout being positioned adjacent said leading edge of said base portion, said guide rails of said ball assembly being coupled to said distal wall of said body member, an exit end of each of said guide rails being positioned proximate said exit cutout of said distal wall such that said guide rails are adapted for guiding the golf ball through said exit cutout for delivering the golf ball to the cut out portion of said base portion.

2. The golf putting training device as set forth in claim 1, further comprising:

said body member having a proximal wall, said proximal wall being coupled to a proximal edge of said base portion opposite said distal wall, said proximal wall and said distal wall being adapted for hampering the back swing of the golfer when the golfer rotates the head of the putter.

3. The golf putting training device as set forth in claim 2, further comprising:

said proximal wall and said distal wall having a plurality distance indicia, each of said distance indicia being adapted for indicating an approximate distance the golf ball will roll when the putter is drawn back and aligned with the associated pair of said distance indicia.

4. The golf putting training device as set forth in claim 3, further comprising:

said base portion of said body member having a plurality of medial indicia, each of said medial indicia being aligned between one of said distance indicia on said distal wall and one of said distance indicia of said proximal wall, said medial indicia extending across an upper surface of said base portion such that each of said medial indicia is adapted for facilitating alignment of the head of the putter with said distance indicia.

5. The golf putting training device as set forth in claim 3, further comprising:

said body member having a gauge member, said gauge member outwardly extending from a front end of said proximal wall, said gage member having said plurality of said distance indicia such that said distance indicia of said gauge member being adapted for indicating a distance the golf ball will travel when the head of the putter is aligned with one of said distance indicia on the follow through of the golfers stroke.

6. The golf putting training device as set forth in claim 1, further comprising:

said base portion of said body member having a center line indicia, said center line being extending along an upper surface of said base portion such that said center line indicia is aligned with the longitudinal axis of said base portion, said center line indicia being adapted for facilitating alignment of a center of the head of the putter with the longitudinal axis of said base portion when the head of the putter is being drawn back.

7. The golf putting training device as set forth in claim 1, further comprising:

said base portion of said body member having an eye indicia, said eye indicia being positioned on an upper surface of said base portion proximate said cut out portion of said base portion, said eye indicia being adapted for reminding the golfer to continue looking at the golf ball throughout the swing.

8. The golf putting training device as set forth in claim 1, further comprising:

said base portion of said body member having a rear portion, said rear portion of said base portion being elevated with respect to a main portion of said base portion.

9. The golf putting training device as set forth in claim 8, further comprising:

said distal wall of said body member having an entrance cutout, said entrance cutout being positioned proximate said rear portion of said base portion, an entrance end of each of said guide rails being positioned proximate said entrance cutout such that said guide rails are adapted for receiving the golf ball pushed through said entrance cutout in said distal wall.

10. The golf putting training device for improving the putting of a golfer, the golf putting training device comprising:

a body member having a base portion, said base portion being adapted for resting on a support surface, said body member having a distal wall, said distal wall being coupled to a distal edge of said base portion, said distal wall being adapted for hampering the back swing of the golfer when the golfer does not draw the putter back straight, said body member having a cut out portion, said cut out portion extending in from a leading edge of said base portion, said cut out portion being adapted for receiving a golf ball, said cut out portion being aligned with a longitudinal axis of said body member such that said cut out portion aliens the golf ball with the longitudinal axis of said base portion;

a ball assembly being coupled to said body member, said ball assembly being adapted for storing golf balls, said ball assembly being adapted for depositing one of the golf balls proximate said cut out portion of said base portion of said body member;

said ball assembly having a pair of guide rails, said guide rails being in a space relationship, said guide rails being adapted for supporting the golf balls between said guide rails such that the golf balls freely roll along a length of said guide rails;

said ball assembly having a restricting arm, said restricting arm being pivotally coupled to said body member, said restricting arm being adapted for inhibiting rolling of the golf balls along said guide rails, said restricting arm being adapted for being engaged by a foot of the golfer such that said restricting arm pivots when engaged by the foot of the golfer for releasing one of the gold balls to roll down said guide rails.

11. The golf putting training device as set forth in claim 10, further comprising:

said restricting arm of said ball assembly having a detaining portion, said detaining portion extending between said guide rails such that said detaining portion is adapted for blocking the golf balls from rolling along said guide rails, said detaining portion of said restricting arm being adapted for being pivoted under the golf balls for allowing the golf balls to roll along said guide rails.

12. The golf putting training device as set forth in claim 11, further comprising:

said restricting arm of said ball assembly having an engaging portion, said engaging portion of said restricting arm being positioned opposite said distal wall of said body member, said engaging portion being adapted for being engaged by the foot of the golfer for selectively pivoting said detaining portion.

13. The golf putting training device as set forth in claim 10, further comprising:

said restricting arm of said ball assembly having a medial portion, said medial portion being pivotally coupled to a rear wall of said body member, said rear wall of said body member being coupled to a rear end of said base portion of said body member.

14. A golf putting training device for improving the putting of a golfer, the golf putting training device comprising:

a body member having a base portion, said base portion being adapted for resting on a support surface, said body member having a distal wall, said distal wall being coupled to a distal edge of said base portion, said distal wall being adapted for hampering the back swing of the golfer when the golfer does not draw the putter back straight, said body member having a cut out portion, said cut out portion extending in from a leading edge of said base portion, said cut out portion being adapted for receiving a golf ball such that said cut out portion aligns the golf ball with a longitudinal axis of said base portion;

said body member having a proximal wall, said proximal wall being coupled to a proximal edge of said base portion opposite said distal wall, said proximal wall and said distal wall being adapted for hampering the back swing of the golfer when the golfer rotates the head of the putter;

said proximal wall and said distal wall having a plurality distance indicia, each of said distance indicia being adapted for indicating an approximate distance the golf ball will roll when the putter is drawn back and aligned with the associated pair of said distance indicia;

said base portion of said body member having a plurality of medial indicia, each of said medial indicia being aligned between one of said distance indicia on said distal wall and one of said distance indicia of said proximal wall, said medial indicia extending across an upper surface of said base portion such that each of said medial indicia is adapted for facilitating alignment of the head of the putter with said distance indicia;

said body member having a gauge member, said gauge member outwardly extending from a front end of said proximal wall, said gage member having said plurality of said distance indicia such that said distance indicia of said gauge member being adapted for indicating a distance the golf ball will travel when the head of the putter is aligned with one of said distance indicia on the follow through of the golfers stroke;

said base portion of said body member having a center line indicia, said center line being extending along said upper surface of said base portion such that said center line indicia is aligned with the longitudinal axis of said base portion, said center line indicia being adapted for facilitating alignment of a center of the head of the putter with the longitudinal axis of said base portion when the head of the putter is being drawn back;

said base portion of said body member having an eye indicia, said eye indicia being positioned on said upper surface of said base portion proximate said cut out portion of said base portion, said eye indicia being adapted for reminding the golfer to continue looking at the golf ball throughout the swing;

a ball assembly being coupled to said body member, said ball assembly being adapted for storing golf balls, said ball assembly being adapted for depositing one of the golf balls proximate said cut out portion of said base portion of said body member;

said ball assembly having a pair of guide rails, said guide rails being in a space relationship, said guide rails being adapted for supporting the golf balls between said guide rails such that the golf balls freely roll along a length of said guide rails;

said distal wall of said body member having an exit cutout, said exit cutout being positioned adjacent said leading edge of said base portion, said guide rails of said ball assembly being coupled to said distal wall of said body member, an exit end of each of said guide rails being positioned proximate said exit cutout of said distal wall such that said guide rails are adapted for guiding the golf ball through said exit cutout for delivering the golf ball to the cut out portion of said base portion;

said base portion of said body member having a rear portion, said rear portion of said base portion being elevated with respect to a main portion of said base portion;

said distal wall of said body member having an entrance cutout, said entrance cutout being positioned proximate said rear portion of said base portion, an entrance end of each of said guide rails being positioned proximate said entrance cutout such that said guide rails are adapted for receiving the golf ball pushed through said entrance cutout in said distal wall;

said ball assembly having a restricting arm, said restricting arm being pivotally coupled to said body member, said restricting arm being adapted for inhibiting rolling of the golf balls along said guide rails, said restricting arm being adapted for being engaged by a foot of the golfer such that said restricting arm pivots when engaged by the foot of the golfer for releasing one of the gold balls to roll down said guide rails;

said restricting arm of said ball assembly having a detaining portion, said detaining portion extending between said guide rails such that said detaining portion is adapted for blocking the golf balls from rolling along said guide rails, said detaining portion of said restricting arm being adapted for being pivoted under the golf balls for allowing the golf balls to roll along said guide rails;

said restricting arm of said ball assembly having an engaging portion, said engaging portion of said restricting arm being along said proximal wall of said body member, said engaging portion being adapted for being engaged by the foot of the golfer for selectively pivoting said detaining portion; and said restricting arm of said ball assembly having a medial portion, said medial portion being pivotally coupled to a rear wall of said body member, said rear wall of said body member being coupled to a rear end of said base portion of said body member.

* * * * *